US012702205B1

(12) United States Patent
Lemerand et al.

(10) Patent No.: US 12,702,205 B1
(45) Date of Patent: Aug. 11, 2026

(54) WALKING CANE WITH A GOLF CLUB HEAD AND AN OBLIQUELY ORIENTED GRIP FOR SUSPENDING A LOAD

(71) Applicant: Rhonda Enterprises, LLC, Daytona Beach, FL (US)

(72) Inventors: L Gale Lemerand, Daytona Beach, FL (US); Scott Frantz, Ormond Beach, FL (US)

( * ) Notice: Subject to any disclaimer, the term of this patent is extended or adjusted under 35 U.S.C. 154(b) by 0 days.

(21) Appl. No.: 19/577,565

(22) Filed: Mar. 25, 2026

(51) Int. Cl.

| | |
|---|---|
| ***A45B 1/00*** | (2006.01) |
| ***A45B 9/02*** | (2006.01) |
| ***A45B 9/04*** | (2006.01) |
| ***A63B 53/04*** | (2015.01) |
| ***A63B 53/14*** | (2015.01) |

(52) U.S. Cl.
CPC ..... *A45B 1/00* (2013.01); *A45B 9/02* (2013.01); *A45B 9/04* (2013.01); *A63B 53/0433* (2020.08); *A63B 53/14* (2013.01); *A45B 2200/05* (2013.01)

(58) Field of Classification Search
CPC ..... A45B 1/00; A45B 9/02
USPC ..... D21/735
See application file for complete search history.

(56) References Cited

U.S. PATENT DOCUMENTS

| | | | | |
|---|---|---|---|---|
| 2,006,429 | A * | 7/1935 | Anderson | B21C 37/185 29/415 |
| 4,601,302 | A | 7/1986 | Breen | |
| 4,796,648 | A * | 1/1989 | Goulter | A45B 9/00 135/65 |
| D317,491 | S * | 6/1991 | Rhodes | D3/7 |
| D319,276 | S * | 8/1991 | Keeler | D3/7 |
| 6,024,110 | A | 2/2000 | Renfro | |
| D463,657 | S * | 10/2002 | Wilkinson | D3/7 |
| 8,540,585 | B2 | 9/2013 | Robinson | |
| 12,108,849 | B1 * | 10/2024 | Nguyen | B25J 15/0608 |
| 12,201,198 | B1 | 1/2025 | Hunt | |
| 2006/0011227 | A1 * | 1/2006 | McBirney | A45B 9/02 135/65 |
| 2008/0083442 | A1 | 4/2008 | Sherman | |
| 2019/0092544 | A1 * | 3/2019 | Martin | A45B 7/005 |
| 2020/0345879 | A1 | 11/2020 | Rapp et al. | |

FOREIGN PATENT DOCUMENTS

JP 3222920 U * 9/2019

OTHER PUBLICATIONS

PDF of a machine translation of Jp 3222920U to Fukuda provided by Google Patents. (Year: 2019).*

* cited by examiner

*Primary Examiner* — Robert Canfield
(74) *Attorney, Agent, or Firm* — Lori Sandman, Esq.

(57) ABSTRACT

A walking cane formed from a golf club includes a club head serving as a base, a shaft extending from the club head and bent at an oblique angle, and a golf club grip installed on a proximal end of the shaft. The golf club grip projects laterally from the shaft and is configured to be gripped by a user and to receive and support a suspended load such as a bag or towel. A first rubber foot and a second rubber foot are attached to the club head and spaced apart from each other. The spacing between the rubber feet resists tipping of the walking cane due to a moment produced by the suspended load. A method of manufacturing includes bending the shaft of a golf club, installing a golf club grip, and attaching rubber feet to the club head.

20 Claims, 3 Drawing Sheets

WALKING CANE WITH A GOLF CLUB HEAD AND AN OBLIQUELY ORIENTED GRIP FOR SUSPENDING A LOAD

CROSS-REFERENCE TO RELATED APPLICATIONS

Not applicable.

STATEMENT REGARDING FEDERALLY SPONSORED RESEARCH/DEVELOPMENT

Not applicable.

REFERENCE TO SEQUENCE LISTING, A TABLE, OR COMPUTER PROGRAM LISTING COMPACT DISC APPENDIX

Not applicable.

FIELD OF INVENTION

The present disclosure relates to walking canes and mobility assistance devices, and more particularly to a walking cane formed from a golf club having a club head serving as a base with attached rubber feet, a shaft bent at an oblique angle, and a golf club grip handle projecting laterally for supporting suspended items.

BACKGROUND

Walking canes have long served as mobility aids, providing balance and support for users during ambulation. Traditional canes typically include a generally vertical shaft, a handle aligned substantially along the axis of the shaft for gripping, and a single ground-engaging tip formed of rubber or similar frictional material.

Various decorative and novelty canes have been developed in which the handle or other components are styled to resemble sporting equipment, including golf clubs or golf-themed ornaments. Such devices are generally intended for aesthetic appeal rather than for providing enhanced functional utility. For example, canes featuring golf club head-shaped handles or putter-style grips are available in the marketplace, though these designs do not utilize actual golf club components in a functional manner.

In other instances, canes have incorporated accessory features such as hooks, clips, or projecting members intended to hold objects such as bags or personal items. These accessories are typically separate components attached to the shaft or handle and are not integrated into the primary structure of the cane. Such designs may introduce instability, awkward load distribution, or interference with normal cane use.

Additionally, stability-enhanced cane bases, including multi-point or quad-style bases, have been developed to reduce slipping and improve balance. While such bases can increase ground contact area, they are generally designed for vertical load support and are not optimized to counteract lateral forces created by loads suspended from the cane. Single-tip cane bases remain prevalent due to their simplicity and ease of use on varied terrain.

Despite these developments, existing walking canes do not provide a structure in which an actual golf club is repurposed or manufactured as a walking cane, with the golf club head serving as a stabilizing base and a laterally projecting grip handle configured to support suspended objects. In particular, there is an absence of canes formed from golf clubs in which the club head functions as the ground-engaging base with attached rubber feet, the shaft is bent at an oblique angle, and a golf club grip is installed to project laterally for hanging items such as bags, towels, or accessories.

Accordingly, there remains a general interest in walking canes that utilize golf club components to combine ergonomic gripping functionality with integrated load-support capability and enhanced stability, including methods for transforming an individual's own golf club into a personalized walking aid.

SUMMARY

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

According to an aspect of the present disclosure, a walking cane is provided. The walking cane includes a golf club having a club head, a shaft extending from the club head, and a golf club grip installed on the shaft. The club head serves as a base of the walking cane and is configured to engage a ground surface. The base may include two or more feet depending on a size and shape of the club head. As used herein, the term "rubber foot" refers to a foot formed of rubber or other materials having durable, weatherproof, and slip-resistant properties, including but not limited to synthetic rubber, silicone, thermoplastic elastomers, and polyurethane. The foot components may be replaceable.

According to other aspects of the present disclosure, the walking cane may include one or more of the following features. The oblique angle may be between approximately 35 degrees and approximately 55 degrees. The oblique angle may be approximately 45 degrees. The golf club grip may include a textured outer surface. The textured outer surface may include at least one of a cord pattern and a rib pattern; it should be appreciated that other patterns creating texture for gripping may be used and would be considered within this disclosure. The golf club grip may include a keeper element disposed at a distal end of the golf club grip; the keeper element may be a bulb, knob, clip or other raised element configured to prevent slippage of a strap of the suspended load from the golf club grip. The golf club may be an iron, a wedge, a putter, a wood, or a hybrid. The suspended load may include, by way of example and not by way of limitation, at least one of a bag and a towel. The first rubber foot and the second rubber foot may be spaced apart by a distance of at least 50 millimeters. The walking cane may be formed by converting an existing golf club or may be manufactured as a new golf club cane.

The foregoing general description of the illustrative embodiments and the following detailed description thereof are merely exemplary aspects of the teachings of this disclosure and are not restrictive.

REFERENCE NUMERALS

100—walking cane
110—club head
112—first rubber foot
114—second rubber foot
120—shaft
130—golf club grip

BRIEF DESCRIPTION OF FIGURES

Non-limiting and non-exhaustive examples are described with reference to the following figures.

DETAILED DESCRIPTION

The following description sets forth exemplary aspects of the present disclosure. It should be recognized, however, that such description is not intended as a limitation on the scope of the present disclosure. Rather, the description also encompasses combinations and modifications to those exemplary aspects described herein.

Figure 1:
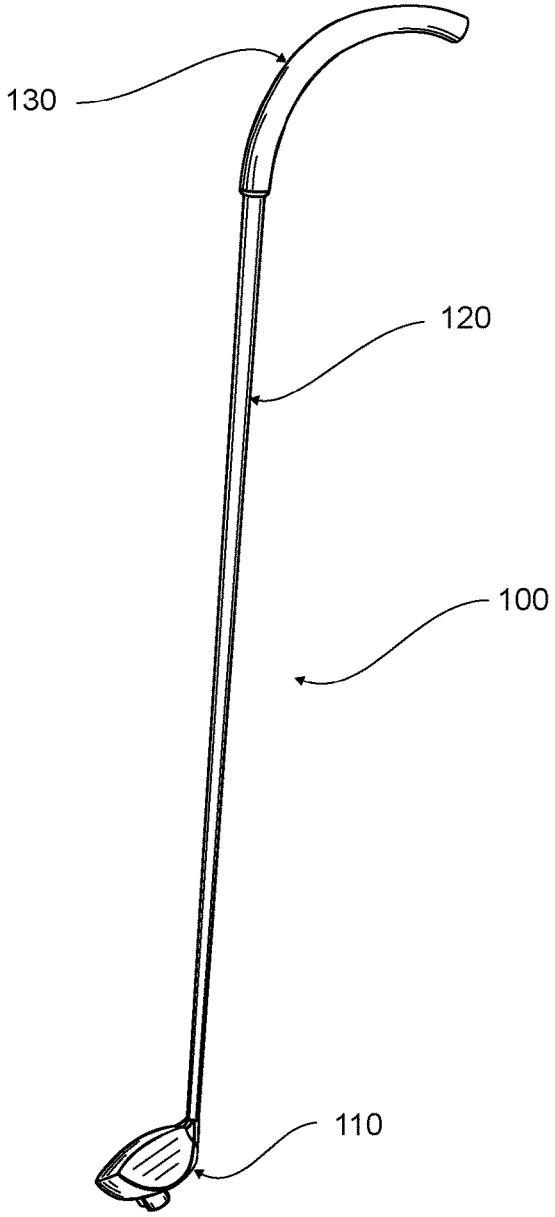
FIG. 1 is a perspective view of a walking cane according to an aspect of the present disclosure.

Referring to FIG. 1, a walking cane 100 according to an aspect of the present disclosure is shown. The walking cane 100 may be formed from an actual golf club, such as an iron, a wedge, a putter, a wood, a hybrid, or any other type of golf club. The walking cane 100 includes a club head 110, a shaft 120 extending from the club head 110, and a golf club grip 130 installed on the shaft 120.

Figure 2:
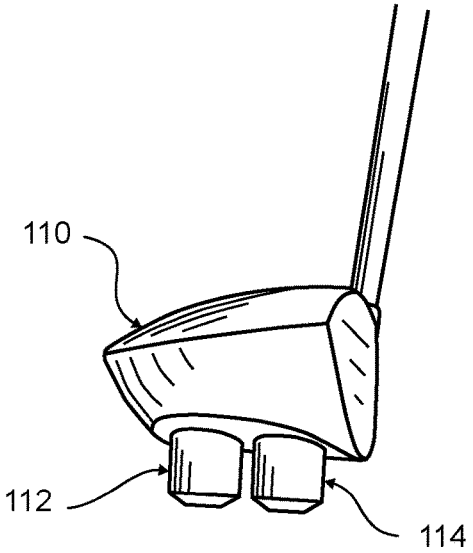
FIG. 2 is a view of the walking cane base.

The club head 110 serves as a base of the walking cane 100 and is configured to engage a ground surface. As shown in FIG. 2, the base includes a first rubber foot 112 and a second rubber foot 114 attached to the club head 110. The first rubber foot 112 and the second rubber foot 114 are spaced apart from each other in a plane transverse to a longitudinal axis of the shaft 120. In some aspects, the first rubber foot 112 and the second rubber foot 114 may be spaced apart by a distance of at least 50 millimeters. The spacing between the first rubber foot 112 and the second rubber foot 114 may be configured to resist tipping of the walking cane 100 due to a moment produced by a suspended load on the golf club grip 130. As used herein, a suspended load on the golf club grip produces a lateral load or lateral force that creates a moment (i.e., a torque or rotational force) tending to tip the walking cane.

In some aspects, the base includes two rubber feet. However, in some aspects, the base may include more than two rubber feet depending on a size and shape of the club head 110. For example, larger club heads such as those found on woods or hybrid clubs may accommodate three or more rubber feet to provide additional stability. The first rubber foot 112 and the second rubber foot 114, as well as any additional rubber feet, may be replaceable.

With continued reference to FIG. 1, the shaft 120 extends from the club head 110 to a proximal end where the golf club grip 130 is installed. The shaft 120 is bent at an oblique angle relative to an original orientation of the shaft 120. In some aspects, the oblique angle may be between approximately 35 degrees and approximately 55 degrees. In some aspects, the oblique angle may be approximately 45 degrees. The bending of the shaft 120 positions the golf club grip 130 to project laterally, which may facilitate gripping by a user and may provide a structure for supporting suspended items.

Figure 3:
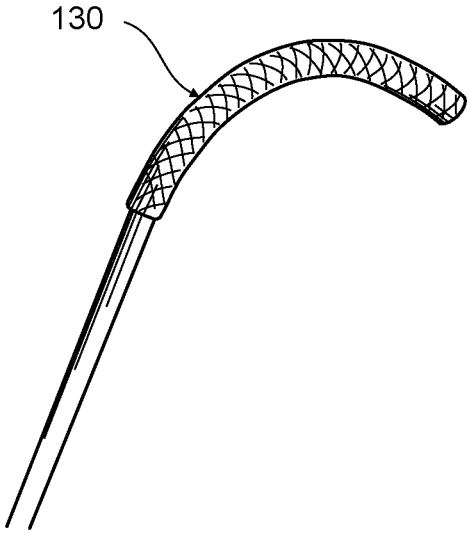
FIG. 3 is a view of the walking cane grip 130.
Figure 4:
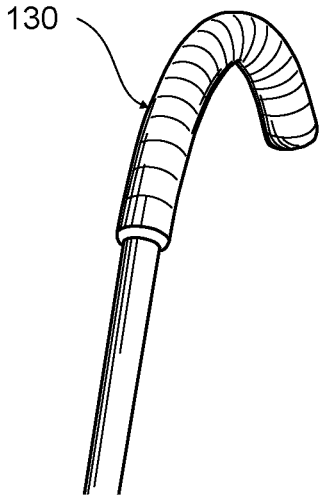
FIG. 4 is a detail view of the grip from an alternative embodiment.

Referring to FIGS. 3 and 4, the golf club grip 130 is shown in detail. The golf club grip 130 may be a standard golf club grip and is disposed at the proximal end of the shaft 120. The golf club grip 130 projects laterally from the shaft 120 due to the bend in the shaft 120. The golf club grip 130 is configured to be gripped by a user during ambulation and is also configured to receive and support a suspended load.

In some aspects, the golf club grip 130 may include a textured outer surface. The textured outer surface may include at least one of a cord pattern and a rib pattern. The textured outer surface may provide enhanced grip for the user and may help retain suspended items on the golf club grip 130. In some aspects, the golf club grip 130 may include a keeper element disposed at a distal end of the golf club grip 130. The keeper element may be configured to prevent slippage of a strap of the suspended load from the golf club grip 130. The keeper element may comprise a bulbous end cap that is larger in diameter than the main body of the golf club grip 130. In some aspects, the keeper element may comprise a ridge or raised portion extending circumferentially around the golf club grip 130. In some aspects, the keeper element may comprise a hook or protrusion extending from the distal end of the golf club grip 130. In some aspects, the keeper element may comprise an enlarged diameter section at the distal end. In some aspects, the keeper element may comprise a textured or tacky surface region configured to increase friction with a strap of the suspended load.

Figure 5:
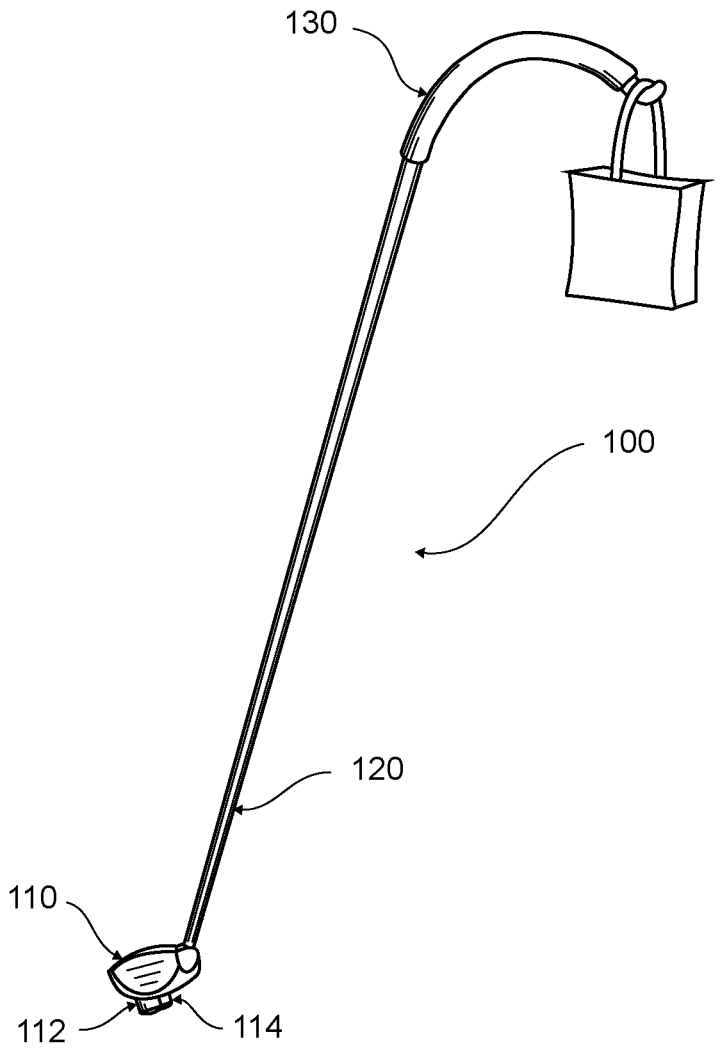
FIG. 5 is a perspective view of the walking cane.

Referring to FIG. 5, the walking cane 100 is shown. In some embodiments, a bag or other load carried by the user may be suspended from the golf club grip 130. The suspended load may include at least one of a bag and a towel, as well as other accessories. The lateral projection of the golf club grip 130 provides a convenient structure for hanging such items. The spacing between the first rubber foot 112 and the second rubber foot 114 on the club head 110 resists tipping of the walking cane 100 due to the moment produced by the suspended load.

According to another aspect of the present disclosure, a method of manufacturing a walking cane from a golf club is provided. The method may include obtaining a golf club having a club head and a shaft. The method may further include bending the shaft at an oblique angle relative to an original orientation of the shaft. In some aspects, the oblique angle may be between approximately 35 degrees and approximately 55 degrees. In some aspects, the oblique angle may be approximately 45 degrees.

The shaft 120 may be bent using various techniques depending on the material of the shaft. For steel shafts, heat bending may be employed in which the shaft is heated to a suitable temperature to allow plastic deformation and then bent to the desired angle. Cold bending techniques may also be used for certain shaft materials. The bend may be formed at a single point along the shaft or may be a gradual bend distributed over a portion of the shaft length. The oblique angle may be measured using a protractor, angle gauge, or other suitable measuring instrument. Different shaft materials, such as steel and graphite, may require different bending techniques. Graphite shafts may require specialized equipment or may be manufactured with the bend pre-formed to avoid damage to the composite material.

The method may further include installing a golf club grip on a proximal end of the shaft. The golf club grip may be a standard golf club grip. The method may also include attaching a first rubber foot and a second rubber foot to the club head. The first rubber foot and the second rubber foot may be spaced apart from each other to resist tipping of the walking cane due to lateral loads. In some aspects, more than two rubber feet may be attached depending on the size and shape of the club head.

The first rubber foot and the second rubber foot may be attached to the club head using various attachment methods.

In some aspects, the rubber feet may be attached using an adhesive, such as an epoxy or other suitable bonding agent. In some aspects, the rubber feet may be attached using mechanical fasteners, such as screws or bolts that engage threaded inserts in the club head or the rubber feet. In some aspects, the rubber feet may be attached using a friction fit in which the rubber feet include a socket or recess configured to receive a portion of the club head. In some aspects, the rubber feet may include threaded inserts embedded therein that engage corresponding threaded fasteners on the club head. The attachment method may depend on the material and configuration of the club head, as well as the desired permanence of the attachment.

In some aspects, the method may include transforming an individual's own golf club into a walking cane. This may allow the individual to repurpose a favorite or sentimental golf club into a functional walking aid. The personalization of the walking cane may provide emotional value to the user in addition to the functional benefits of stability and load support.

In some aspects, the walking cane 100 may be manufactured as a new golf club cane rather than being converted from an existing golf club. In such aspects, the golf club components may be manufactured specifically for use as a walking cane, with the shaft pre-bent to the appropriate angle and the rubber feet pre-installed on the club head.

The walking cane 100 may provide several benefits. The use of the club head 110 as the base with spaced-apart rubber feet may provide enhanced stability compared to single-tip canes. The lateral projection of the golf club grip 130 may provide a convenient and integrated structure for supporting suspended items without the need for auxiliary attachments. The ability to transform an individual's own golf club into a walking cane may provide personalization and sentimental value.

A number of implementations have been described. Nevertheless, it will be understood that various modifications may be made without departing from the spirit and scope of the disclosure. Accordingly, other implementations are within the scope of the following claims.

The invention claimed is:

1. A walking cane comprising:

a golf club having a club head and a shaft extending from the club head, wherein the shaft is bent at an oblique angle relative to an original orientation of the shaft;

a golf club grip installed on a proximal end of the shaft, wherein the golf club grip projects laterally from the shaft and is configured to receive and support a suspended load;

wherein the club head serves as a base of the walking cane and is configured to engage a ground surface; and a first rubber foot and a second rubber foot attached to the club head and spaced apart from each other, wherein the spacing between the first rubber foot and the second rubber foot is configured to resist tipping of the walking cane due to a moment produced by the suspended load on the golf club grip.

2. The walking cane of claim 1, wherein the oblique angle is between approximately 35 degrees and approximately 55 degrees.

3. The walking cane of claim 1, wherein the oblique angle is approximately 45 degrees.

4. The walking cane of claim 1, wherein the golf club grip includes a textured outer surface.

5. The walking cane of claim 4, wherein the textured outer surface includes at least one of a cord pattern and a rib pattern.

6. The walking cane of claim 1, wherein the golf club grip includes a keeper element disposed at a distal end of the golf club grip, the keeper element configured to prevent slippage of the suspended load from the golf club grip.

7. The walking cane of claim 1, wherein the golf club is at least one of an iron, a wedge, a putter, a wood, and a hybrid.

8. The walking cane of claim 1, wherein the first rubber foot and the second rubber foot are spaced apart by a distance of at least 50 millimeters.

9. The walking cane of claim 1, wherein the first rubber foot and the second rubber foot are replaceable.

10. The walking cane of claim 1, wherein the base includes more than two rubber feet.

11. A method of manufacturing a walking cane from a golf club, the method comprising:

obtaining a golf club having a club head and a shaft;

bending the shaft at an oblique angle relative to an original orientation of the shaft;

installing a golf club grip on a proximal end of the shaft, wherein the golf club grip projects laterally from the shaft; and attaching a first rubber foot and a second rubber foot to the club head, wherein the first rubber foot and the second rubber foot are spaced apart from each other, whereby the walking cane resists tipping due to a moment produced by a suspended load on the golf club grip.

12. The method of claim 11, wherein the oblique angle is between approximately 35 degrees and approximately 55 degrees.

13. The method of claim 11, wherein the oblique angle is approximately 45 degrees.

14. The method of claim 11, wherein the golf club is an individual's own golf club.

15. The method of claim 11, wherein attaching the first rubber foot and the second rubber foot includes positioning the first rubber foot and the second rubber foot to resist tipping of the walking cane due to lateral loads.

16. The method of claim 11, further comprising attaching one or more additional rubber feet to the club head based on a size and shape of the club head.

17. The method of claim 11, wherein the golf club grip is a standard golf club grip.

18. A walking cane and suspended load system comprising:

a golf club having a club head and a shaft extending from the club head, wherein the shaft is bent at an oblique angle;

a golf club grip installed on a proximal end of the shaft, wherein the golf club grip projects laterally from the shaft;

a first rubber foot and a second rubber foot attached to the club head and spaced apart from each other, wherein the club head with the first rubber foot and the second rubber foot serves as a base of the walking cane; and a suspended load supported by the golf club grip, wherein the spacing between the first rubber foot and the second rubber foot resists tipping of the walking cane due to a moment produced by the suspended load.

19. The walking cane and suspended load system of claim 18, wherein the suspended load includes at least one of a bag and a towel.

20. The walking cane and suspended load system of claim 18, wherein the golf club grip is configured to receive and support a suspended load comprising at least one of a bag, a towel, and an accessory.

* * * * *